United States Patent [19]

Prince

[11] Patent Number: 4,538,631

[45] Date of Patent: Sep. 3, 1985

[54] ORAL HYGIENE INSTRUMENT

[76] Inventor: Mary F. Prince, 1839 Neimann Dr., Cape Girardeau, Mo. 63701

[21] Appl. No.: 490,230

[22] Filed: Apr. 29, 1983

[51] Int. Cl.[3] ..... A45D 44/18; A46B 13/20

[52] U.S. Cl. ..... 132/84 R; 15/167 R; 433/91

[58] Field of Search ..... 433/91, 92, 93, 94, 433/95, 96; 401/13, 176, 287, 288, 289; 128/62 R, 62 A; 604/313; 15/167 R, 167 A, 302, 398, 399; 132/84 R, 85

[56] References Cited

U.S. PATENT DOCUMENTS

| | | | |
|---|---|---|---|
| 452,131 | 5/1891 | Haughawout | 604/313 |
| 1,025,504 | 5/1912 | Birrell | 604/313 |
| 1,148,093 | 7/1915 | Kells | 604/313 |
| 1,792,712 | 2/1931 | Roscher | 15/398 |
| 1,894,905 | 1/1933 | Fechtenburg | 604/313 |
| 2,036,789 | 4/1936 | Baker | 15/398 |
| 2,637,106 | 5/1953 | Otis | 433/91 |
| 2,885,782 | 5/1959 | Groves | 433/95 |
| 3,134,127 | 5/1964 | Klein | 401/13 |
| 3,135,989 | 6/1964 | Gatti | 401/289 |
| 3,520,300 | 7/1970 | Flower, Jr. | 433/91 |
| 3,589,823 | 6/1971 | Hendrickson | 401/176 |
| 4,311,404 | 1/1982 | Kodera | 401/287 |

*Primary Examiner*—Robert P. Swiatek
*Assistant Examiner*—Carolyn A. Harrison
*Attorney, Agent, or Firm*—Rogers, Howell, Renner, Moore & Haferkamp

[57] ABSTRACT

An oral hygiene instrument has a handle having a brush on one end and a suction hose connector on the other end. An internal bore begins at an opening in the center of the brush and extends through the handle to the suction hose connector. A suction system of the type found in most hospitals may be connected to the connector in order to evacuate any moisture or debris adjacent the opening.

6 Claims, 2 Drawing Figures

ORAL HYGIENE INSTRUMENT

This invention relates to oral hygiene instruments, for use in the oral cavity, the instruments being a type used to scrub the teeth and tissues, such as gums, tongue, cheeks, and the like.

There are many different forms of oral hygiene instruments, such as toothbrushes, which work well when used on a normal person who is sitting or standing in an upright position and who has the mental and physical ability to respond properly. However, these instruments cannot provide a regular oral hygiene for persons who cannot assume an upright position, such as patients confined to bed in hospitals, nursing homes, or the like, as well as in their own home. This is especially true when it is uncomfortable or even impossible to raise the patient's head. Problems also occur with mentally and physically handicapped individuals, both children and adults, who need help with oral hygiene, and who cannot be depended upon to follow directions or who are unable to resist swallowing any solution which may be in their mouth. Still other problems which the invention addresses relate to the cleaning of the tissues in a toothless mouth.

The invention can be used on unconscious patients, patients with advanced periodontal disease, tumors, or oral conditions that might otherwise cause excessive hemorrhaging of the tissues. The invention is also useful for edentulous mouths to cleanse the tissues.

Heretofore, it has been necessary to use an aspirator while performing an oral hygiene procedure on an incapacitated patient, such as described above. This, in turn, often required two people, one to perform a task as simple as brushing an invalid's teeth and the other to manipulate the aspirator. Moreover, the aspirator was in the way so that the oral hygiene could not always be a thorough and complete job.

For these and similar reasons, it becomes difficult or impossible to provide adequate oral hygiene with conventional brushes.

Accordingly, an object of the invention is to provide new and improved means and methods for providing oral hygiene for persons who are unable either to care for themselves or to assume a vertical position. In particular, an object is to provide an oral hygiene device which evacuates any fluids and debris which may collect in the mouth while the oral hygiene is in progress.

Another object of the invention is to provide an oral hygiene instrument, especially one that is well suited for some hospital uses and is compatible with vacuum systems which are conventionally found in most hospitals. Here, an object is to eliminate the need for a separate aspirator during oral hygiene. Further, an object is to enable one person to perform a complete and thorough hygiene, without obstacles (such as aspirators) in the way.

In keeping with an aspect of the invention, these and other objects are accomplished by an aspirating brush having an elongated, generally tubular handle beginning with a connector tip adapted to fit into suction equipment found in most hospitals, as, for example, equipment used with suction catheters. From this connector tip, the tubular handle leads to an opening or input port in the center of the brush. Surrounding the opening or port are a plurality of conventional tufts of bristles or extra soft, ball type, nylon bristles. As the brush is used to scrub the teeth or mouth tissues, any excess fluids, moisture or debris, which would otherwise build up in the mouth, are evacuated by a suction system hooked to the connector tip.

A preferred embodiment of the invention is shown in the attached drawing, in which.

Figure 1:
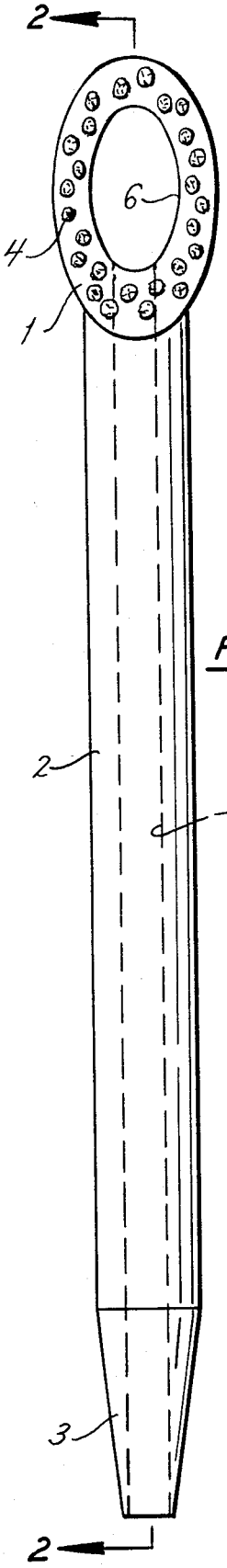
FIG. 1 is a front elevational view of the inventive brush.
Figure 2:
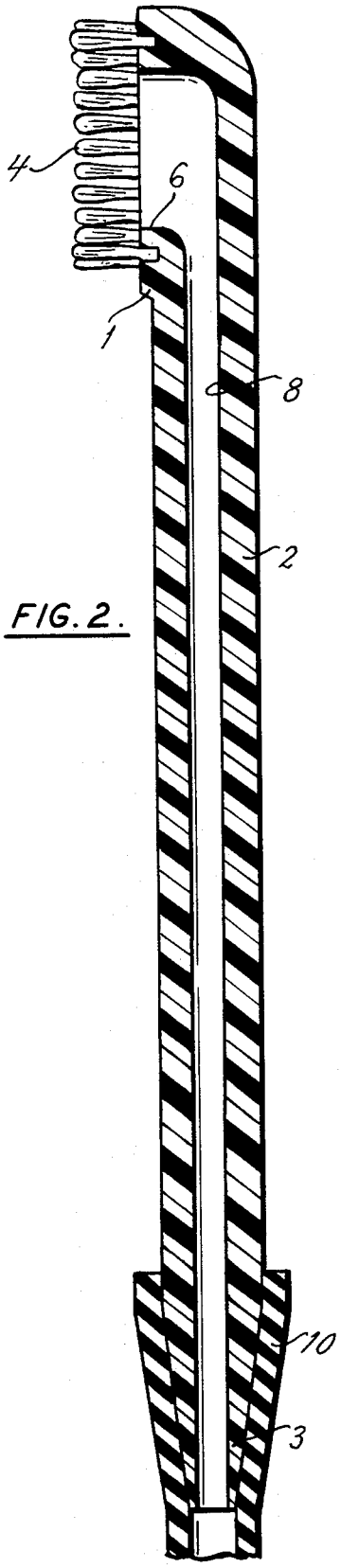
FIG. 2 is a cross sectional view taken along line 2—2 of FIG. 1, with a portion of a suction system attached thereto.

The brush shown in these figures is designed to loosen and evacuate dental plaque, stimulate the gingivae, and reduce the bacterial build-up on the cheeks and tongue. Moisture and debris are evacuated to eliminate a need for aspiration during the oral hygiene procedure. The inventive brush may or may not be dipped into mouthwash or fluoride gel prior to use depending upon the patient's needs and ability to resist swallowing.

The inventive structure includes a brush 1 having a number of bristles 4 arranged in a generally oval configuration. The rounded end of the brush and its supporting structure is preferred since the person using the brush cannot feel the pain which might otherwise be inflicted upon a patient by square corners found on most toothbrushes. These bristles 4 may be conventional tufts of nylon monofilament, as found in conventional toothbrushes, or extra-soft, ball-tipped nylon. Also, soft natural bristles may be used, if desired. In one embodiment, the bristles were made of filaments ¼-inch long and 0.005 inches in diameter, but any suitable length and diameter brisles may be used. For adults, the brush 1 is preferably one inch long and for children, it is ¾-inch long, which is relatively small as compared to most toothbrushes.

The center of the brush includes an opening 6 leading into and communicating with the bore 8 of a tubular handle 2. The bore 8 extends from the brush 1 to a connector end 3. The connector end 3 is shaped and dimensioned to be connected to a standard hose fitting on a suction catheter tube 10. In one embodiment, the fitting was a type used in a system associated with the trademarks "Maxi-Flex" and "Vac", and the suction tubing 10 was 5 mm tubing. The handle 2 was made from a high-impact polystyrene and was serrated on its outer surface to facilitate gripping.

The preferred overall length of the instrument is 5¼ inches for the adult size and 5 inches for the children's size. Where suitable, other lengths may be used.

The preferred mode of use is to dip the brush into a mouthwash or a fluoride gel. Then, the brush is used with small circular motions above the gumline to cleanse and stimulate the gingivae and short brushing strokes on all surfaces of the teeth that are accessible. Because of the relatively small brush head size, most areas of the mouth can be reached by the inventive instrument. After the teeth are cleaned, the rest of the oral tissues (tongue, cheeks, palate and inside lips) are cleansed. After use, the brush may be cleaned by simply flushing it with water.

Those who are skilled in the art will readily perceive how to modify the invention. Therefore, the appended claims are to be construed to cover all equivalent structures which fall within the true scope and spirit of the invention.

The claimed invention is:

1. An aspirating tooth and mouth brush instrument for use with a suction system in providing oral hygiene to persons unable to assume an upright position or by handicapped or disabled persons, comprising:

(a) an elongated tubular handle sized for gripping and control by the fingertips of a single human hand, the handle having a first closed end with a first opening projecting in a radial direction from the axis of the tubular handle at a position near the first end;

(b) a plurality of bristles projecting substantially perpendicular to a plane extending along the axis of the handle, the bristles forming a tooth and mouth brush and surrounding the first opening, the bristles having a softness suitable for brushing the mouth and gums;

(c) the handle having a second end, the handle having a second opening for connection to the suction system;

(d) the handle having a bore extending from flow connection to the first opening to flow connection with the second opening so that the suction system can draw fluid from the mouth through the first opening thence through the bore to the second opening; and (e) the handle and the brush being unencumbered by any adjoining structure and having no means for injecting fluid into the mouth, and sized to be easily inserted through the mouth opening into the mouth, and easily maneuvered and positioned within the mouth to contact any desired portion of a tooth.

2. The aspirating tooth and mouth brush of claim 1 wherein said brush bristles are arranged in an oval configuration surrounding the first opening, and wherein the first end of the handle is rounded and smooth.

3. The aspirating tooth and mouth brush of claim 1 wherein said bristles are tufted nylon filaments of about $\frac{1}{4}$ inch long and about 0.005 inches in diameter.

4. The structure of claim 1 wherein said brush bristles are extra soft, ball-typed nylon.

5. The structure of claim 1 wherein the brush has a length ranging from about $\frac{3}{4}$ inch to about 1 inch and the length of the handle ranges from about 5 inches to about $5\frac{1}{4}$ inches.

6. An aspirating tooth and mouth brush instrument for use with a suction system in providing oral hygiene to persons unable to assume an upright position or by handicapped or disabled persons, comprising:

(a) an elongated tubular handle sized for gripping and control by the fingertips of a single human hand, the handle having a first rounded and smooth closed end with a first opening projecting in a radial direction from the axis of the tubular handle at a position near the first end;

(b) a plurality of bristles arranged in an oval configuration projecting substantially perpendicular to a plane extending along the axis of the handle, the bristles forming a tooth and mouth brush and surrounding the first opening, the bristles having a softness suitable for brushing the mouth and gums comprising the bristles being extra soft, ball typed nylon;

(c) the handle having a second end, the second end having a second opening for connection to the suction system;

(d) the handle having a bore extending from flow connection to the first opening to flow connection with the second opening so that the suction system can draw fluid from the mouth through the first opening thence through the bore to the second opening; and (e) means for the brush and handle to be easily inserted through the teeth into the mouth, and easily maneuvered and positioned within the mouth to contact any desired portion of a tooth, comprising the handle having a length ranging from about 5 inches to about $5\frac{1}{4}$ inches, and the length of the brush along the axis of the handle ranging from about $\frac{3}{4}$ inch to about one inch, the thickness of the handle being no greater than the overall transverse width of the brush in a direction approximately perpendicular to the handle axis, and the handle and brush being unencumbered by any adjoining structure or by any means to inject fluid into the mouth.

* * * * *